United States Patent [19]

Walters

[11] 4,035,138

[45] July 12, 1977

[54] APPARATUS FOR CONVERTING A BEVERAGE CONTAINER INTO A LAMP

[76] Inventor: Ben Walters, 2751 S. Ocean Drive, Hollywood, Fla. 33019

[21] Appl. No.: 717,740

[22] Filed: Aug. 25, 1976

[51] Int. Cl.[2] ..... F23D 3/24

[52] U.S. Cl. ..... 431/320; 431/125; 431/156; 431/315

[58] Field of Search ..... 431/298, 301, 305, 315, 431/320, 321, 322, 324, 125, 156, 325; 126/43, 44, 45, 49; 240/13

[56] References Cited

U.S. PATENT DOCUMENTS

| | | | |
|---|---|---|---|
| 1,044,041 | 11/1912 | Fusner | 431/324 |
| 3,994,672 | 11/1976 | Novak | 431/320 |

FOREIGN PATENT DOCUMENTS

| | | | |
|---|---|---|---|
| 842,622 | 3/1939 | France | 431/315 |
| 662,040 | 6/1938 | Germany | 431/320 |

*Primary Examiner*—Edward G. Favors
*Attorney, Agent, or Firm*—Howard C. Miskin

[57] ABSTRACT

An oil lamp includes beverage can of the tab opening type having a sector shaped discharge opening and defining an oil reservoir. A resilient wire helix wick holder engages the upper portion of a wick and engages between successive convolutions the opposite convergent edges of the discharge opening, the wick being immersed in the oil in the can and projecting a short distance above the helix. Alternatively, the wick holder is a pair of telescoping collars having opposing flanges embracing the inner opposite borders of the discharge opening and engaging the wick.

9 Claims, 5 Drawing Figures

FIG. 1
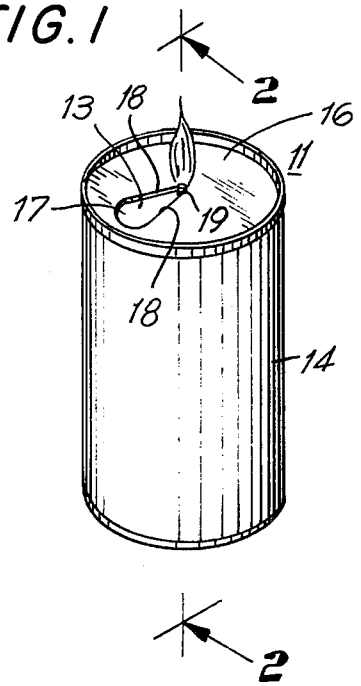
FIG. 2
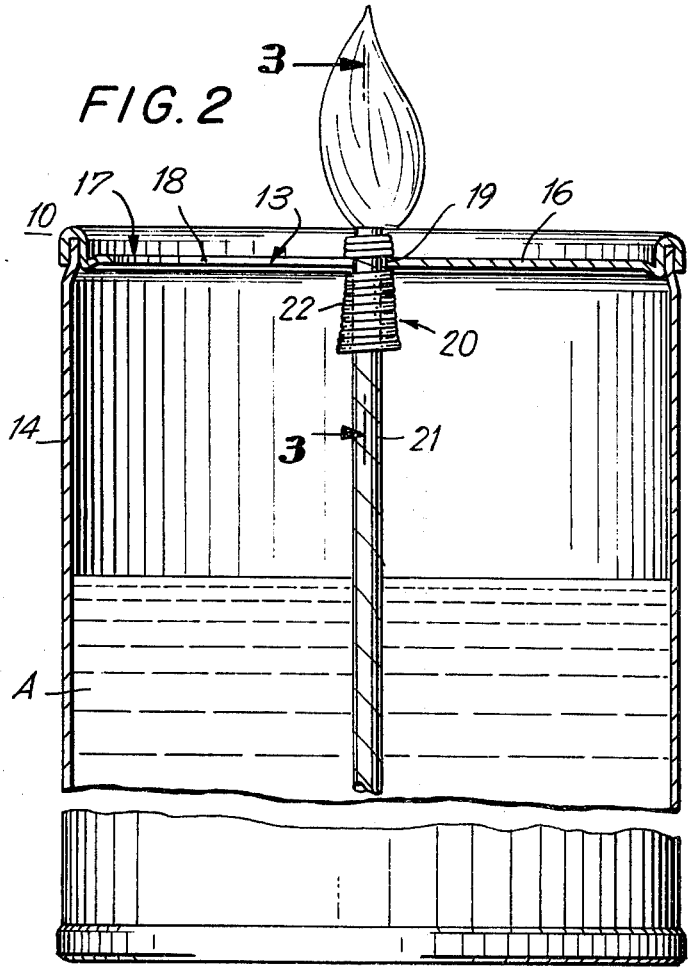
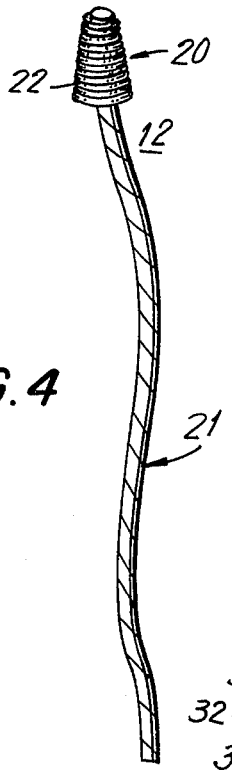
FIG. 4
FIG. 3
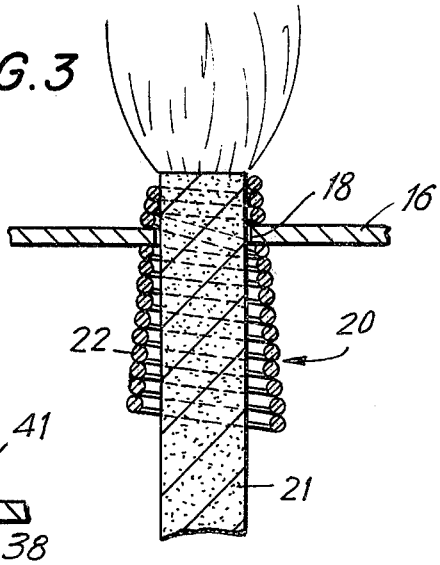
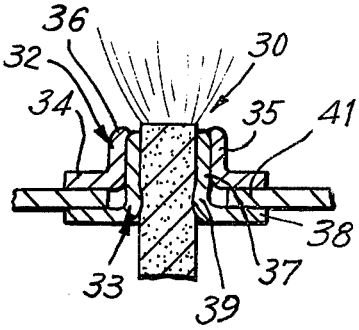
FIG. 5

APPARATUS FOR CONVERTING A BEVERAGE CONTAINER INTO A LAMP

BACKGROUND OF THE INVENTION

The present invention relates generally to improvements in lighting devices and it relates more particularly to an improved oil lamp. It is frequently desirable for decorative or limited lighting purposes and often necessary for emergency purposes to provide a non-electrical light source which is readily available and is compact for easy storage. While a candle may be used to this end, it possesses numerous drawbacks in that it is seldom a common household item, it requires a sturdy and often bulky and awkward holder and is inconvenient to store, and generally deforms in a warm environment. The conventional oil or kerosene lamp does not remedy the disadvantages of a candle in that it is generally a bulky device, is difficult to store, is of limited application and otherwise leaves much to be desired.

SUMMARY OF THE INVENTION

It is a principal object of the present invention to provide an improved lamp.

Another object of the present invention is to provide an improved oil lamp.

Still another object of the present invention is to provide an improved oil lamp, the major component of which is a common disposable object generally found in the household.

A further object of the present invention is to provide a lamp of the above nature characterized by its simplicity, low cost, reliability, compactness of the unique elements thereof and its great versatility and adaptability.

The above and other objects of the present invention will become apparent from a reading of the following description taken in conjunction with the accompanying drawing which illustrates preferred embodiments thereof.

In a sense, the present invention contemplates the provision of an improved oil lamp comprising an oil reservoir sheet metal container including top and bottom walls and a cylindrical peripheral wall, the top wall having formed therein a radially extending opening with inwardly convergent longitudinal side edges, a tubular wick holder registering with the opening proximate its convergent end and engaging said opening side edges to restrain the wick holder against movement, and a wick engaged by the wick holder and depending therefrom into the container and projecting above the top of the wick holder. An important feature which characterizes the improved lamp so that the major component thereof, the fuel or oil reservoir, is a common disposable household item, a beer or soft drink disposable can of the conventional type provided with an opening ring or tab which when pulled produces an approximately sector shaped discharge opening in the top wall of the can.

Advantageously, the wick holder is a resilient wire helix in which successive convolutions abut and which tapers upwardly and inwardly. The side borders of the can discharge opening are embraced between successive helix convolutions at the inner end of the discharge opening, the helix projecting above the top wall a few convolutions. Alternatively, the wick holder may consist of a pair of snap coupled telescoping collars having opposite peripheral flanges which embrace the inner side borders of the can discharge opening.

The improved oil lamp is simple, reliable, inexpensive, employs as its major component a generally available disposable household item and is of great versatility and adaptability.

BRIEF DESCRIPTION OF THE DRAWINGS

FIG. 1 is a perspective view of the liquid fuel reservoir of a preferred embodiment of the present invention;

FIG. 2 is a sectional view taken along line 2—2 in FIG. 1 with the wick and wick holder shown in assembled position;

FIG. 3 is an enlarged sectional view taken along line 3—3 in FIG. 2;

FIG. 4 is a perspective view of the wick and wick holder assembly; and

FIG. 5 is a view similar to FIG. 3 of another embodiment of the present invention.

DESCRIPTION OF THE PREFERRED EMBODIMENTS

Referring now to the drawing, particularly FIGS. 1 to 4 thereof, which illustrates a preferred embodiment of the present invention, the reference numeral 10 generally designates the improved liquid fuel lamp which includes a liquid fuel reservoir defining container 11 and a wick and wick holder assembly 12.

The container 11 is a conventional metal beverage can of the well known type including a ring or pull tab attached to the inner or apex end of a sector shaped opening section delineated by a line of weakness formed in the top wall of the can. The can is opened by pulling the tab to leave in the top wall of a sector shaped discharge opening 13 through which the beer, soft drink or other beverage is dispensed and the can is then air dried. The container 11 includes a circular cylindrical peripheral wall 14, a circular bottom wall and a circular top wall 16 in which the discharge opening 13 is formed. The discharge opening 13 has an enlarged outer section 17 proximate the outer peripheral edge of top wall 16, the outer edge of outer section 17 being curved and joining radially converging opening side edges which join at an inner apex 15 proximate the center of top wall 16.

The assembly 12 comprises a wick holder 20 and a wick 21, the wick 21 being cylindrical and of any known suitable capillary construction and preferably non-inflammable composition. The wick holder 20 is of tubular configuration, uniformly inwardly upwardly tapering and is formed of resilient metal wire 22 which is helically wound into a tube with successive convolutions being contiguous or abutting and the diameter of the convolutions diminishing upwardly to provide a corresponding tubular taper. While the successive convolutions may be separated they are resiliently biased into mutual abutment.

The wick 21 is advantageously of slightly greater diameter than the upper convolutions of the helical wick holder 20 and extends through the wick holder and is engaged by the upper convolutions of the wick holder helix. The wick 21 advantageously projects between about one thirty-second and one-sixteenth of an inch above the top of the wick holder 20 and is of a length greater than the height of the container 11.

In preparing the lamp 10 for use, the container 11 is filled with any suitable liquid fuel, for example a lamp oil, to the desired depth and the wick 21 is soaked in and saturated with the liquid fuel.

The upper end of the wick holder 20 is grasped and the wick 21 and wick holder 20 are inserted into the discharge opening enlarged outer section 17. The wick carried by the wick holder 20 is then advanced radially inwardly along the discharge opening to bring the opening side edges into engagement with the interface of a pair of successive wire convolutions, to spread the convolutions apart which tightly embrace the opposite faces of the borders of the discharge opening 13. The edge engaging wick holder 20 is then advanced into close proximally with the apex or inner end 19 of the discharge opening 13. The opening edge is preferably embraced between the second to fourth convolution and the next successively lower convolution, advantageously between the third and fourth convolutions from the top of the wick holder. The wick now be lit and it produces a bright smokeless flame.

In FIG. 5 of the drawing there is illustrated another embodiment of the present invention which differs from that first described only in the construction of the wick holder. Specifically, the modified wick holder 30 comprises a pair of singly flanged upper and lower mutually telescoping snap locked resilient metal collars 32 and 33 respectively.

The upper collar 32 includes a tubular body 35 provided at its top with a peripheral flange 34 and inwardly bent at its lower free end to provide an inwardly directed peripheral locking ridge 36. The lower collar 33 includes a tubular body 37 slidably telescoping the tubular body 35 and provided at its bottom with a peripheral flange 38 and having formed at the inside junction angle of flange 38 and tubular body 37 a peripheral locking groove 39 separably engaging the wick member 21.

In the assembled lamp the wick holder 30 supports a wick which projects through the bore of tubular body 37 and is slightly clinched thereby and projects above the top of flange 34 preferably between one thirty-second and one-sixteenth of an inch. The wick holder is located proximate the inner apex of the container discharge opening 40 whose side borders 41 are embraced by and between the flanges 34 and 38. The separably and snap coupling of the collars 32 and 33 expedite the application of the wick and wick holder assembly to the oil reservoir or container. While the upper and lower collars were shown to be of the same diameter and thickness, advantageously the flange on the upper collar can be wider as well as thicker than the flange on the lower collar to aid in placement of the wick holder. Also, the upstanding collar surrounds the wick and prevents impeding capillary flow of the wick when it is wedged inside the can opening. Further, the collars may face the same direction to reduce the space between their respective flanges so as to provide a tight holding action with the can top. Also the collars may be split to allow bending inward to hold the wick in position. In other respects and in operation the last described embodiment is similar to that first described.

To prevent inadvertent displacement of the wick in the first embodiment, when the wick is in its desired position, it can be forced between adjacent coils of the helix to hold it in fixed position. Also, while the helix was shown positioned in the inner convergent end, could also be positioned elsewhere along the edges of the opening by forcing successive convolutions onto the edge. The coil could be of the same diameter throughout rather than be in the shape of a cone. Further while a sheet metal can was illustrated, any heat resistant material could be used.

While there have been described and illustrated preferred embodiments of the present invention it is apparent that numerous alterations, additions and omissions may be made without departing from the spirit thereof.

I claim:

1. A liquid fuel lamp comprising a fuel reservoir defining sheet metal container including a cylindrical peripheral wall and top and bottom walls, said top wall having an opening therein with longitudinally extending inwardly convergent side edges, a tubular wick holder registering with said opening proximate the inner end of said opening and engaging the edges of said opening to restrain the movement of said wick holder and a wick member registering with said wick holder and depending therefrom into said reservoir and projecting above said wick holder.

2. The lamp of claim 1 wherein said opening side edges converge from proximate the peripheral edge of said top wall to proximate the center thereof.

3. The lamp of claim 1 wherein said wick holder comprises a metal wire helix having normally contiguous successive convolutions, the side borders of said opening being embraced between a pair of successive convolutions of said helix.

4. The lamp of claim 3 wherein said helix tapers inwardly upwardly.

5. The lamp of claim 3 wherein said helix projects between two and four convolutions above the top face of said top wall.

6. The lamp of claim 1 wherein said wick projects between one thirty-second and one-sixteenth of an inch above the top edge of said wick holder.

7. The lamp of claim 1 wherein said container comprises an open beverage can of the pull tab opening type.

8. The lamp of claim 1 wherein said wick holder comprises a pair of telescoping collars having longitudinally spaced opposing peripheral flanges embracing the side edges of said opening.

9. The lamp of claim 8 wherein one of said collars has a peripheral groove and the other collar has a peripheral ridge engaging said peripheral groove to effect a snap coupling between said collars.

* * * * *